US006236262B1

(12) United States Patent
Mellot

(10) Patent No.: US 6,236,262 B1
(45) Date of Patent: May 22, 2001

(54) REGULATED POWER SUPPLY WITH A HIGH INPUT NOISE REJECTION RATIO

(75) Inventor: Pascal Mellot, Lans En Vercors (FR)

(73) Assignee: STMicroelectronics S.A., Gentilly (FR)

( * ) Notice: Subject to any disclaimer, the term of this patent is extended or adjusted under 35 U.S.C. 154(b) by 0 days.

(21) Appl. No.: 09/494,002

(22) Filed: Jan. 28, 2000

(51) Int. Cl.[7] ..... G05F 1/10
(52) U.S. Cl. ..... 327/540; 327/563
(58) Field of Search ..... 327/534, 535, 327/537, 538, 539, 540, 541, 543, 545, 546, 561, 562, 563

(56) References Cited

U.S. PATENT DOCUMENTS 5,359,552 10/1994 Dhong et al. ..... 365/189.09
6,133,779 * 10/2000 Sichert et al. ..... 327/540

FOREIGN PATENT DOCUMENTS 0 434 435 A2 12/1990 (EP) .
0 751 451 A1 6/1995 (EP) .
0 661 616 A2 7/1995 (EP) .

* cited by examiner

*Primary Examiner*—Jeffrey Zweizig
(74) *Attorney, Agent, or Firm*—Theodore E. Galanthay; Allen, Dyer, Doppelt, Milbraith & Gilchrist, P.A.

(57) ABSTRACT

A device for generating a regulated DC voltage from a DC power supply voltage source includes a loop formed by a reference voltage generator powering an operational amplifier. The output of the operational amplifier powers the input to the reference voltage generator.

25 Claims, 1 Drawing Sheet

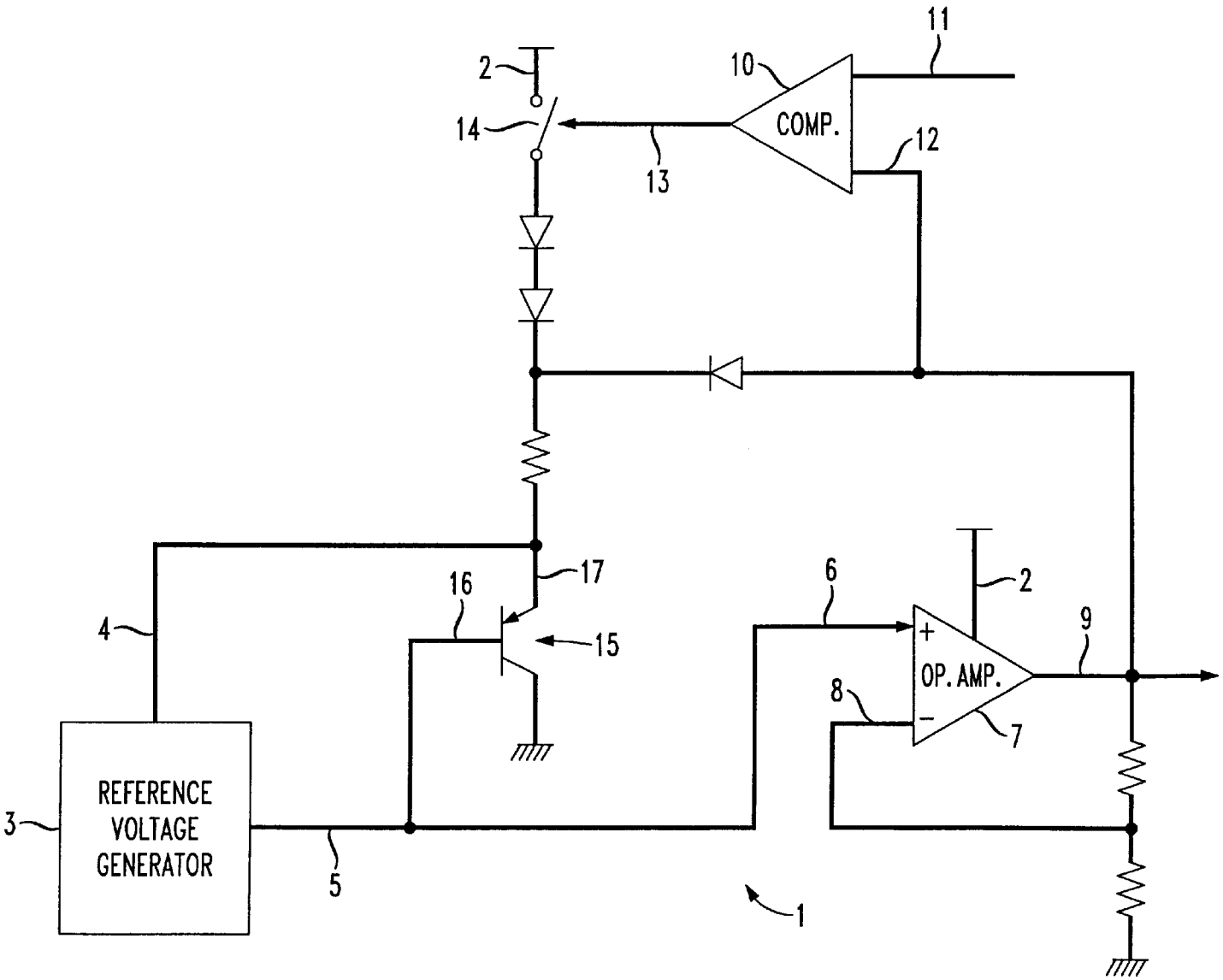
COMP.
OP. AMP.
REFERENCE VOLTAGE GENERATOR
1
2
3
4
5
6
7
8
9
10
11
12
13
14
15
16
17

REGULATED POWER SUPPLY WITH A HIGH INPUT NOISE REJECTION RATIO

FIELD OF THE INVENTION

This invention relates to the field of power supply regulation, and more particularly, to regulated power supplies for low noise microphone preamplifiers.

BACKGROUND OF THE INVENTION

Devices capable of outputting a regulated DC voltage from an unregulated voltage are known for use in an integrated circuit. One example of a known circuit of this type is the "band gap core" circuit, or the "polarization circuit with a reference voltage output by a difference differential" as described in the "Analysis and Design of Analog Integrated Circuits" manual published by Paul T. GRAY and Robert G. MEYER in 1984, second edition under number ISBN 0471-81454 7, pages 4–181 and subsequent pages.

This type of circuit is capable of achieving a noise rejection ratio for noise from an unregulated power supply equal to about 40 to 70 decibels. This ratio is insufficient, particularly in the case of a power supply for a preamplifier for a signal output by the microphone in a camera with a universal standard bus port. In this type of camera, the main power supply has a large amount of noise due to the many sudden changes in power consumption. Typically, the regulated voltage is filtered, for example, using additional R.C. filters, but these filters are not very efficient at the low frequencies present in the audio range. Furthermore, these filters are not necessarily possible on integrated circuit chips.

Another disadvantage of self-polarized circuits like those described in the manual mentioned above, is that the output regulated voltage is necessarily less than the unregulated power supply voltage. Consequently, a sufficiently high unregulated voltage is necessary so that the regulated voltage after division is sufficient to be useable by standard circuits on the load side. This is not always the case, particularly on portable equipment such as cameras.

Accordingly, there is a need for a regulated power supply with a better noise rejection ratio for noise in the unregulated power supply voltage. This ratio is preferably between 100 dB or more. The better noise rejection ratio should also be at low audio frequencies, and the level of this power supply should be sufficiently high for use by these circuits on the load side.

SUMMARY OF THE INVENTION

According to the invention, a conventional reference voltage generating circuit will be used and the voltage obtained at the output will be coupled to the input of an operational amplifier. The output of the operational amplifier will form the unregulated voltage input to the reference voltage generator.

The operational amplifier performs two functions. Firstly, it amplifies the reference voltage at the output from the reference voltage generator. Secondly, it reduces the noise at the input by about 50 decibels. Considering noise specific to components and possibly to an adapter stage between the reference voltage generator and the operational amplifier, it is impossible to expect that the total rejection will be the sum of the rejections, namely about 120 dB. However, it is possible to approach or exceed 100 decibels. Thus, a voltage at a suitable level is available with a noise rejection ratio of noise from the unregulated power supply of about a 100 dB.

The system that has just been described necessitates a startup phase during which the reference voltage generator is powered by the unregulated power supply voltage. This startup phase terminates as soon as the output voltage from the operational amplifier becomes sufficiently large to power the generator in turn. At the end of this startup phase, the power supply for the reference voltage generator is switched from the unregulated power supply voltage to the voltage at the output from the operational amplifier.

In sum, the invention relates to a device for generation of a regulated DC voltage starting from a DC power supply voltage source. The device includes a reference voltage circuit with the DC power supply voltage being applied to one input. The reference voltage circuit supplies an output voltage pre-regulated to a level that is a fraction of the DC power supply voltage equal to or less than 1. The device includes the output from the reference voltage generator circuit carrying the pre-regulated voltage being coupled to a first input to an operational amplifier with a second input and one output. The output carries the regulated DC voltage, and a feedback voltage taken from the output from the operational amplifier is applied to the second input. This output is coupled to the input of the reference voltage generator.

BRIEF DESCRIPTION OF THE DRAWINGS

An example embodiment of this invention will now be described with reference to the FIGURE which shows a block diagram of an embodiment of the invention.

DETAILED DESCRIPTION OF THE PREFERRED EMBODIMENTS

The sole FIGURE shows an example embodiment of a power supply according to the invention. The circuit 1 shown in the FIGURE includes a reference voltage generator 3 with the output 5 coupled to a first input 6 of an operational amplifier 7. The output 9 of the operational amplifier 7 is coupled in feedback to the input 4 of the reference voltage generator 3. The reference voltage generator 3, may include, for example, a first balanced current mirror and a second unbalanced current mirror, with a balancing resistor between the two unbalanced arms of the second mirror, the voltage at the terminals of this second resistor then forming the reference voltage, as would be appreciated by the skilled artisan. This reference voltage is equal to a fraction (less than 1) of the power supply voltage present on an input 4 of the reference voltage generator 3.

The operational amplifier 7, is polarized by the unregulated power supply voltage source 2 and a fraction of the voltage present on output 9 is applied to its second input 8. This fraction is determined as a function of the amplification ratio to be obtained between input 2 and output 9. Operation in steady state mode is as follows. The output 9 from operational amplifier 7 powers the input 4 to reference voltage generator 3, for example, through a diode and a resistor as shown. Output 5 from this generator powers the first input 6 to the operational amplifier 7. Consequently, the circuit operates in a closed loop and the power supply voltage received on the first input 6 to the operational amplifier 7 has already been pre-regulated by the reference voltage generator 3. This pre-regulated voltage is once again regulated by the operational amplifier 7, such that attenuations of noise in the power supply voltage to source 2 are accumulated.

For the startup phase, to obtain a voltage at the output 5 from the reference voltage generator 3, the source 2 has to be connected to the input 4 of this reference voltage generator 3.

To obtain steady state operation of the loop described above, the output 9 from the operational amplifier is coupled to a circuit 10, 14 for disconnecting the source 2 from the input 4 to the reference voltage generator 3. In the example shown, this circuit includes a comparator 10 with two inputs 11, 12 and an output 13. The input 11 receives a threshold voltage, the input 12 receives the voltage present at the output 9 from operational amplifier 7 and output 13 controls a switch 14 to disconnect the source 2 from the input 4 whenever the value of the voltage present on output 9 from the operational amplifier reaches the value of the threshold voltage present on the first input 11 of the comparator 10.

Advantageously, to increase the value of the rejection ratio of the power supply voltage present on the power supply source 2 of the operational amplifier 7, the output 5 from the voltage generator 3 is connected to a feedback stage 15 of the output voltage on the input 4 to the reference voltage generator 3. In the case shown in the FIGURE, a PNP transistor is used in which the base forms the input 16 to the feedback stage and in which the emitter 17 forms the output from this feedback stage 15. Consequently, the circuit comprises a double feedback loop, one loop being composed of the reference voltage generator 3 and the feedback stage 15, and a second loop being composed of the voltage generator 3 and the operational amplifier 7.

That which is claimed is:

1. A device for generation of a regulated DC voltage from a DC power supply voltage source, the device comprising:

a reference voltage generator for receiving the DC power supply voltage and for supplying a pre-regulated voltage that is a fraction of the DC power supply voltage; and an operational amplifier having first and second inputs and an output, the first input receiving the pre-regulated voltage, the output delivering the regulated DC voltage and being connected to an input of the reference voltage generator, and the second input receiving a feedback voltage from the output of the operational amplifier.

2. A device according to claim 1, further comprising:

a DC power supply voltage source connectable to the input of the reference voltage generator; and a switching circuit for controlling the connection and disconnection of the DC power supply voltage source from the input to the reference voltage generator.

3. A device according to claim 2, wherein the switching circuit comprises:

a switch between the DC power supply source and the input of the reference voltage generator; and a comparator with first and second inputs, and an output, the first input being connected to a threshold voltage, the second input being connected to the output of the operational amplifier, and the output controlling the switch.

4. A device according to claims 1, further comprising a feedback stage connected between the output of the reference voltage generator and the input of the reference voltage generator.

5. A regulated DC voltage generator comprising:

a reference voltage generator for receiving a DC power supply voltage and for generating a pre-regulated voltage; and an operational amplifier for receiving the pre-regulated voltage and for generating a regulated DC voltage, an output of the operational amplifier being connected to an input of the reference voltage generator and to an input of the operational amplifier.

6. A regulated DC voltage generator according to claim 5, wherein the pre-regulated voltage generated by reference voltage generator is a fraction of the DC power supply voltage.

7. A regulated DC voltage generator according to claim 5, further comprising:

a DC power supply voltage source connectable to the reference voltage generator; and a switching circuit for connecting and disconnecting the DC power supply voltage source from the reference voltage generator.

8. A regulated DC voltage generator according to claim 7, wherein the switching circuit comprises:

a switch between the DC power supply voltage source and the reference voltage generator; and a comparator for comparing a threshold voltage with the regulated DC voltage to control the switch.

9. A regulated DC voltage generator according to claim 5, further comprising a feedback stage connected between an output of the reference voltage generator and the input of the reference voltage generator.

10. A regulated DC voltage generator according to claim 9, wherein the feedback stage comprises a transistor with the base connected to the output of the reference voltage generator, and the emitter connected to the input of the reference voltage generator.

11. A microphone preamplifier comprising:

a DC power supply voltage source for supplying a DC power supply voltage; and a regulated DC voltage generator for generating a regulated DC voltage, the regulated DC voltage generator comprising a reference voltage generator for receiving the DC power supply voltage and for generating a pre-regulated voltage, and an operational amplifier for receiving the pre-regulated voltage and for generating the regulated DC voltage, an output of the operational amplifier being connected to an input of the reference voltage generator and to an input of the operational amplifier.

12. A microphone preamplifier according to claim 11, wherein the pre-regulated voltage generated by reference voltage generator is a fraction of the DC power supply voltage.

13. A microphone preamplifier according to claim 11, further comprising a switching circuit for connecting and disconnecting the DC power supply voltage source from the reference voltage generator.

14. A microphone preamplifier according to claim 13, wherein the switching circuit comprises:

a switch between the DC power supply voltage source and the reference voltage generator; and a comparator for comparing a threshold voltage with the regulated DC voltage to control the switch.

15. A microphone preamplifier according to claim 11, wherein the regulated DC voltage generator further comprises a feedback stage connected between an output of the reference voltage generator and the input of the reference voltage generator.

16. A microphone preamplifier according to claim 15, wherein the feedback stage comprises a transistor with the base connected to the output of the reference voltage generator, and the emitter connected to the input of the reference voltage generator.

17. A method for generating a regulated DC voltage comprising the steps of:

generating a pre-regulated voltage from a DC power supply voltage and a feedback regulated DC voltage, the pre-regulated voltage being a fraction of the DC power supply voltage;

generating a regulated DC voltage from the pre-regulated voltage; and providing the feedback regulated DC voltage from the regulated DC voltage.

18. A method according to claim 17, further comprising the step of comparing a threshold voltage with the regulated DC voltage to connect and disconnect the DC power supply voltage.

19. A method according to claim 17, further comprising the step of providing a feedback pre-regulated voltage for the step of generating a pre-regulated voltage.

20. A method of making a regulated DC voltage generator, the method comprising the steps of:

providing a reference voltage generator for receiving a DC power supply voltage and for generating a pre-regulated voltage;

providing an operational amplifier for receiving the pre-regulated voltage and for generating a regulated DC voltage; and connecting an output of the operational amplifier to an input of the reference voltage generator and to an input of the operational amplifier.

21. A method according to claim 20, wherein the pre-regulated voltage generated by reference voltage generator is a fraction of the DC power supply voltage.

22. A method according to claim 20, further comprising the steps of:

providing a DC power supply voltage source connectable to the reference voltage generator; and providing a switching circuit for connecting and disconnecting the DC power supply voltage source from the reference voltage generator.

23. A method according to claim 22, wherein the step of providing the switching circuit comprises:

providing a switch between the DC power supply voltage source and the reference voltage generator; and providing a comparator for comparing a threshold voltage with the regulated DC voltage to control the switch.

24. A method according to claim 20, further comprising the step of connecting a feedback stage between an output of the reference voltage generator and the input of the reference voltage generator.

25. A method according to claim 24, wherein the step of connecting the feedback stage comprises connecting a base of a transistor to the output of the reference voltage generator, and connecting an emitter of the transistor to the input of the reference voltage generator.

* * * * *

UNITED STATES PATENT AND TRADEMARK OFFICE

CERTIFICATE OF CORRECTION

PATENT NO. : 6,236,262 B1
DATED : May 22, 2001
INVENTOR(S) : Pascal Mellot

It is certified that error appears in the above-identified patent and that said Letters Patent is hereby corrected as shown below:

Title Page,
Item [30], .under Foreign Application Priority Data insert,

-- [30] Foreign Application Priority Data
Jan. 28, 1999 (FR).....99 00948 --

Signed and Sealed this

Sixth Day of November, 2001

*Attest:*

Nicholas P. Godici

*Attesting Officer*

NICHOLAS P. GODICI
*Acting Director of the United States Patent and Trademark Office*